US007973298B2

(12) United States Patent
Shimojo et al.

(10) Patent No.: US 7,973,298 B2
(45) Date of Patent: Jul. 5, 2011

(54) TRANSPORT/STORAGE CASK FOR RADIOACTIVE MATERIAL

(75) Inventors: Jun Shimojo, Takasago (JP); Hiroshi Akamatsu, Takasago (JP); Hiroaki Taniuchi, Takasago (JP); Kenichi Mantani, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 584 days.

(21) Appl. No.: 12/185,328

(22) Filed: Aug. 4, 2008

(65) Prior Publication Data

US 2009/0114856 A1 May 7, 2009

(30) Foreign Application Priority Data

Oct. 10, 2007 (JP) ..... 2007-264034

(51) Int. Cl.
*G21F 5/00* (2006.01)
*G21C 11/00* (2006.01)

(52) U.S. Cl. ..... 250/506.1; 250/507.1; 250/518.1

(58) Field of Classification Search ..... 250/506.1, 250/518.1, 507.1; 376/272, 260
See application file for complete search history.

(56) References Cited

U.S. PATENT DOCUMENTS

| | | | | |
|---|---|---|---|---|
| 3,930,166 | A | 12/1975 | Bochard | |
| 4,535,250 | A | 8/1985 | Fields | |
| 4,862,007 | A * | 8/1989 | Mallory | 250/506.1 |
| 5,641,970 | A * | 6/1997 | Taniuchi et al. | 250/506.1 |
| 5,887,042 | A * | 3/1999 | Akamatsu et al. | 376/272 |
| 6,195,404 | B1 * | 2/2001 | Lemogne et al. | 376/272 |
| 6,389,093 | B1 * | 5/2002 | Gluschke et al. | 376/272 |
| 6,498,826 | B2 * | 12/2002 | Gluschke et al. | 376/260 |
| 6,625,247 | B1 * | 9/2003 | Ohsono et al. | 376/272 |
| 6,839,395 | B2 * | 1/2005 | Ohsono et al. | 376/272 |
| 7,176,472 | B2 * | 2/2007 | Funakoshi et al. | 250/506.1 |
| 7,194,060 | B2 * | 3/2007 | Ohsono et al. | 376/272 |
| 7,327,821 | B2 * | 2/2008 | Ishihara et al. | 376/272 |
| 7,342,989 | B2 * | 3/2008 | Pennington et al. | 376/272 |
| 7,351,989 | B2 * | 4/2008 | Morishige | 250/506.1 |
| 2003/0102445 | A1 * | 6/2003 | Kamoshida et al. | 250/507.1 |
| 2004/0067328 | A1 * | 4/2004 | Taniuchi et al. | 428/34.4 |
| 2005/0157833 | A1 * | 7/2005 | Ishihara et al. | 376/272 |
| 2005/0224729 | A1 * | 10/2005 | Tamaki | 250/507.1 |
| 2005/0286674 | A1 | 12/2005 | Fischer et al. | |
| 2006/0219960 | A1 * | 10/2006 | Shimojo et al. | 250/518.1 |

FOREIGN PATENT DOCUMENTS

| | | |
|---|---|---|
| JP | 2004-156930 | 6/2004 |
| JP | 2004-156997 | 6/2004 |

* cited by examiner

*Primary Examiner* — Robert Kim
*Assistant Examiner* — Johnnie L Smith
(74) *Attorney, Agent, or Firm* — Oblon, Spivak, McClelland, Maier & Neustadt, L.L.P.

(57) ABSTRACT

A transport/storage cask for a radioactive material has an inner shell, an outer shell and a circular gamma ray shielding layer and a circular neutron shielding layer both of which are placed between the inner shell and the outer shell. The gamma ray shielding layer is formed by aligning a plurality of gamma ray shielding blocks composed of lead in a block shape in the circumferential direction. The entire gamma ray shielding block in the axial direction is covered with a copper tube having a higher elasticity limit than the gamma ray shielding block. In the above transport/storage cask, the gamma ray shielding layer composed of lead or a lead alloy is not easily deformed.

20 Claims, 9 Drawing Sheets

TRANSPORT/STORAGE CASK FOR RADIOACTIVE MATERIAL

BACKGROUND OF THE INVENTION

1. Field of the Invention

The present invention relates to a transport/storage cask for the radioactive material such as spent nuclear fuel.

2. Description of the Related Art

As the above type of technology, U.S. Pat. No. 5,641,970 discloses a transport/storage cask for a radioactive material in which a gamma ray shielding layer and a neutron shielding layer are provided between an inner shell and an outer shell. The gamma ray shielding layer is formed by a plurality of divided block bodies in the circumferential direction, and the block bodies are composed of lead.

Certainly, as mentioned in the above Patent Document, when a shielding performance with regard to gamma ray and cost are taken into consideration, lead is the most suitable for a material of the block bodies. However, as already known, since lead is easily deformed by external force, there is a need for improvement in terms of strength. Particularly, at the time of a so-called 9 m drop test, by inertia force due to impact acceleration, the block bodies of lead are locally crushed so as to extend in the horizontal direction. Therefore, there is a possibility that length in the axial direction of the transport-storage cask is shortened so as to generate a partial clearance.

SUMMARY OF THE INVENTION

The present invention is achieved in consideration to the above points, and a major object of the present invention is to provide a transport-storage cask for a radioactive material in which a gamma ray shielding layer composed of lead or a lead alloy is not easily deformed.

The problems to be solved by the present invention are described as above. Next, a description will be given to means for solving the above problems and an effect thereof.

In accordance with a view of the present invention, a transport/storage cask for a radioactive material formed as below will be provided. That is a transport/storage cask for a radioactive material comprises an inner shell, an outer shell, a circular gamma ray shielding layer placed between the inner shell and the outer shell, the gamma ray shielding layer being formed by aligning a plurality of gamma ray shielding blocks composed of lead or a lead alloy in a block shape in the circumferential direction, and a circular neutron shielding layer placed between the inner shell and the outer shell, wherein at least a part of each of the gamma ray shielding blocks is covered with a first metal member having a higher elasticity limit than the gamma ray shielding blocks. According to the above configuration, the gamma ray shielding blocks are not easily deformed.

The transport/storage cask for the radioactive material is further formed as below. That is, the first metal member has a higher thermal conductivity than the gamma ray shielding blocks. By adopting the first metal member having the above characteristic, the first metal member contributes to thermal conduction between the inner shell and the outer shell.

The transport/storage cask for the radioactive material is further formed as below. That is, the first metal member is aluminum, an aluminum alloy, copper or a copper alloy. By adopting the above materials, the first metal member having a high elasticity limit and high thermal conductivity can be inexpensively obtained.

The transport/storage cask for the radioactive material is further formed as below. That is, a plurality of protruding portions for protruding into each of the gamma ray shielding blocks are formed on a cover surface serving as a surface of the first metal member opposing to each of the gamma ray shielding blocks. According to the above configuration, since the gamma ray shielding block is closely engaged with the first metal member through the above protruding portions, the gamma ray shielding blocks are further not easily deformed.

The transport/storage cask for the radioactive material is further formed as below. That is, a plurality of openings are formed in the first metal member, and a plurality of protrusions are formed in each of the gamma ray shielding blocks, at least a part of the protrusions being placed within the openings. According to the above configuration, since the gamma ray shielding block is closely engaged with the first metal member through the above protrusions, the gamma ray shielding blocks are further not easily deformed.

The transport/storage cask for the radioactive material is further formed as below. That is, the first metal member has a section in a U shape. According to the above configuration, in comparison with the case where the first metal member is formed in a tubular shape, reinforcement of the gamma ray shielding block by the first metal member is not largely deteriorated. The first metal member originally formed is flat, and with using a die having a section in a concave shape, the first metal member is bent by a pressing machine and wound around the gamma ray shielding block. Such an economical manufacturing method of the transport/storage cask for the radioactive material can be obtained.

The transport/storage cask for the radioactive material is further formed as below. That is, the first metal member is arranged so that an opening part of the U shape may oppose to the inner shell. According to the above configuration, the first metal member wraps up the gamma ray shielding block from the outer shell side. Therefore, even with a section in a U shape, in comparison to the case where the first metal member is formed in a tubular shape, the reinforcement of the gamma ray shielding block by the first metal member is not inferior.

The transport/storage cask for the radioactive material is further formed as below. That is, each of the gamma ray shielding blocks has an overlapping portion overlapping with other circumferentially neighboring gamma ray shielding block in the radial direction. According to the above configuration, radiation streaming can be more surely prevented.

The transport/storage cask for the radioactive material is further formed as below. That is, the neutron shielding layer is composed of an organic material including hydrogen, and the organic material is a resin material or a rubber material. By adopting the above material, neutron is shielded without any problem. Since the above material includes a lot of hydrogen which is light and effective for shielding the neutron, the above material is excellent as a neutron shielding material.

The transport/storage cask for the radioactive material is further formed as below. That is, the neutron shielding layer is formed by aligning a plurality of neutron shielding blocks in a block shape. As mentioned above, by adopting a configuration in which the neutron shielding layer is formed by a plurality of the neutron shielding blocks, various manufacturing modes such as manufacturing the neutron shielding blocks in a separate process prior to manufacturing the transport/storage cask are available.

The transport/storage cask for the radioactive material is further formed as below. That is, the neutron shielding blocks are formed in a circular shape and arranged on an outer periphery of a plurality of the gamma ray shielding blocks. According to the above configuration, since a plurality of the gamma ray shielding blocks are lashed, the gamma ray shielding blocks are further not easily deformed.

The transport/storage cask for the radioactive material is further formed as below. That is, at least a part of each of the neutron shielding blocks is covered with a second metal member having a higher elasticity limit than the neutron shielding blocks. According to the above configuration, the neutron shielding blocks are not easily deformed.

The transport/storage cask for the radioactive material is further formed as below. That is, the second metal member has a higher thermal conductivity than the neutron shielding blocks. By adopting the second metal member having the above characteristic, the second metal member contributes to the thermal conduction between the inner shell and the outer shell.

The transport/storage cask for the radioactive material is further formed as below. That is, the second metal member is aluminum, an aluminum alloy, copper or a copper alloy. By adopting the above materials, the second metal member having a high elasticity limit and high thermal conductivity can be inexpensively obtained.

The transport/storage cask for the radioactive material is further formed as below. That is, the second metal member has a section in a U shape. According to the above configuration, in comparison with the case where the second metal member is formed in a tubular shape, reinforcement of the neutron shielding block by the second metal member is not largely deteriorated. The second metal member originally formed is flat, and with using a die having a section in a concave shape, the second metal member is bent by a pressing machine and wound around the neutron shielding block. Such an economical manufacturing method of the transport/storage cask for the radioactive material can be obtained.

The transport/storage cask for the radioactive material is further formed as below. That is, a gel material is coated over at least one of among a contact surface between the inner shell and the gamma ray shielding layer or the neutron shielding layer, a contact surface between the gamma ray shielding layer and the neutron shielding layer, and a contact surface between the outer shell and the gamma ray shielding layer or the neutron shielding layer. According to the above configuration, the thermal conduction between the inner shell and the outer shell is improved.

The transport/storage cask for the radioactive material is further formed as below. That is, the gel material is silicon or a silicon material. According to the above configuration, the thermal conduction between the inner shell and the outer shell is further improved, and the gel material is also excellent in radiation resistance.

The transport/storage cask for the radioactive material is further formed as below. That is, a reinforcing material having a higher elasticity limit than the gamma ray shielding blocks is buried within each of the gamma ray shielding blocks. According to the above configuration, the gamma ray shielding blocks are further not easily deformed.

DESCRIPTION OF THE PREFERRED EMBODIMENTS

Figure 1:
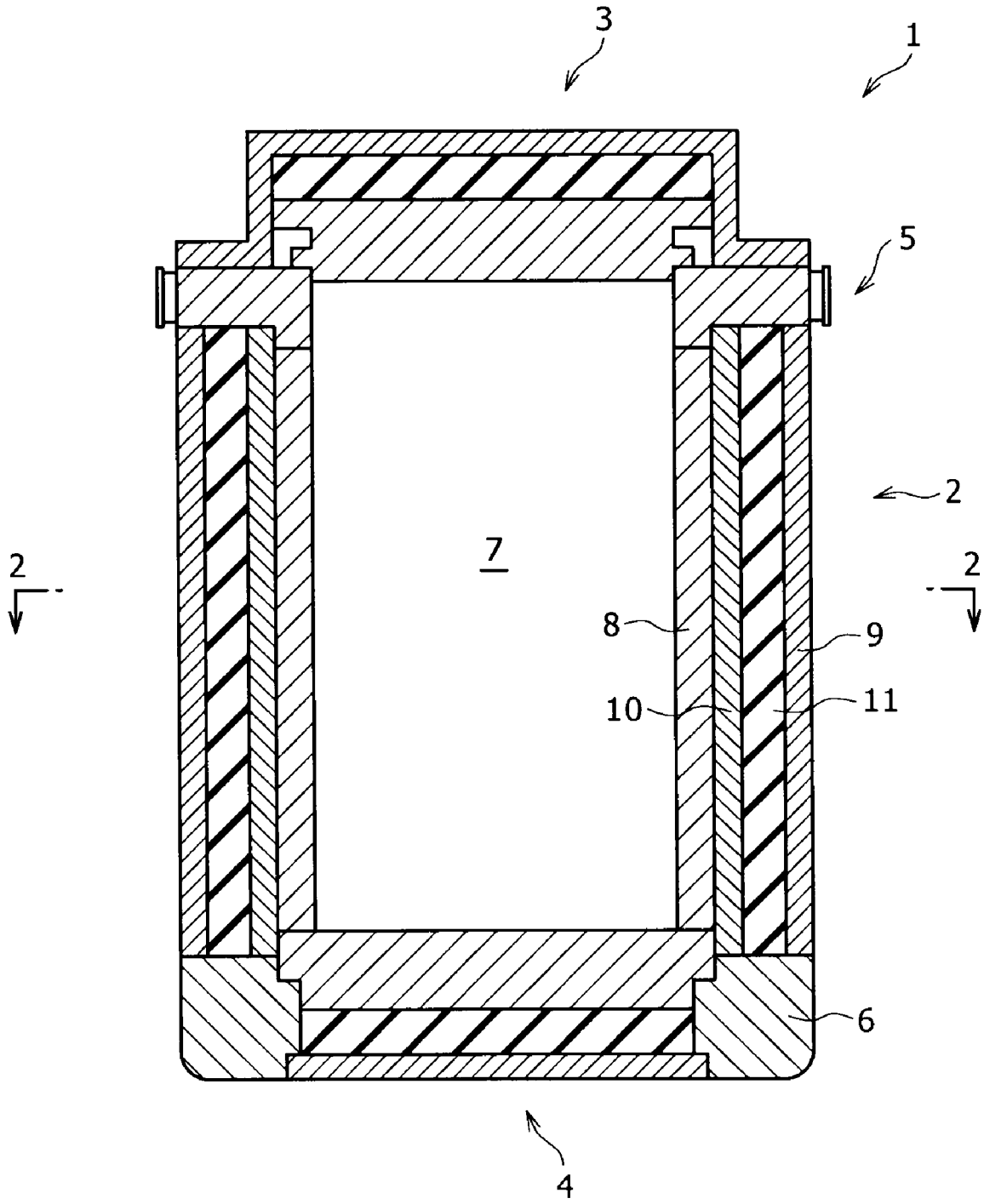
FIG. 1 is a vertically sectional view of a transport/storage cask for a radioactive material according to a first embodiment of the present invention.
Figure 2:
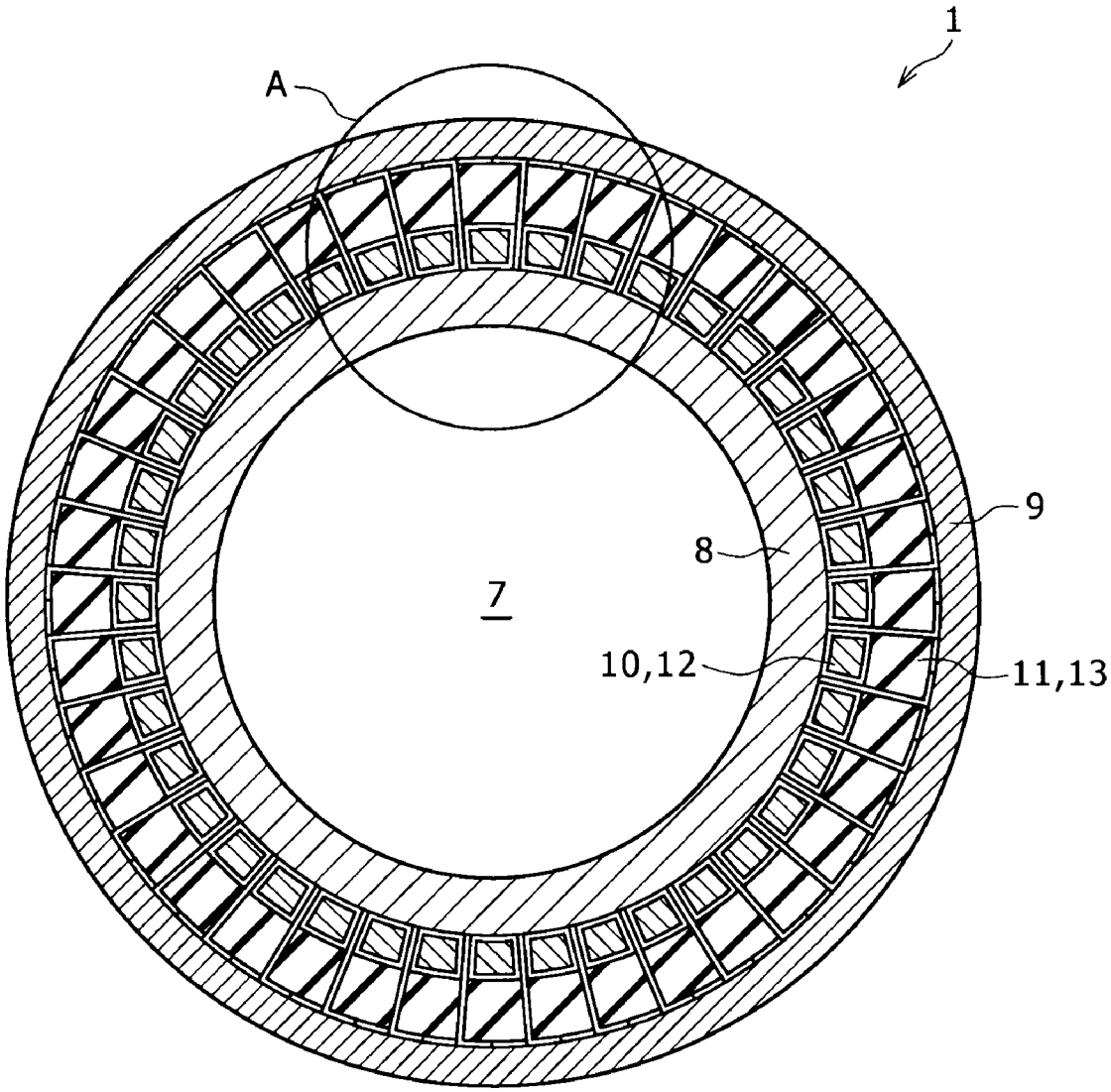
FIG. 2 is a sectional view by the line 2-2 of FIG. 1.
Figure 3:
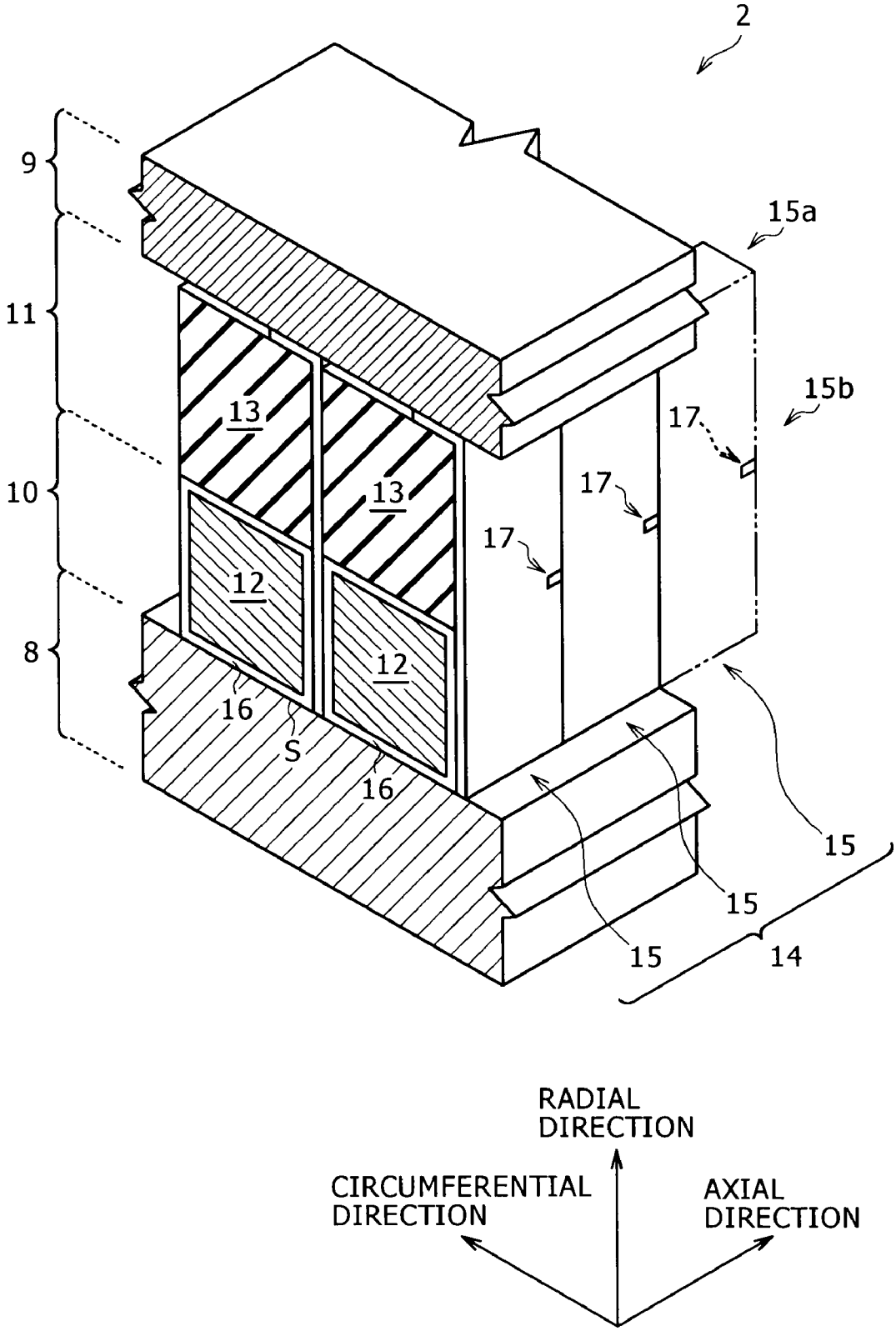
FIG. 3 is a perspective view of a part A of FIG. 2.

Hereinafter, with reference to FIGS. 1 to 3, a description will be given to a first embodiment of the present invention. FIG. 1 is a vertically sectional view of a transport/storage cask for a radioactive material according to the first embodiment of the present invention. FIG. 2 is a sectional view by the line 2-2 of FIG. 1. FIG. 3 is a perspective view of a part A of FIG. 2.

As shown in FIGS. 1 and 2, a transport/storage cask 1 for a radioactive material according to the first embodiment of the present invention has a cylindrical shell portion 2, an upper lid 3 and a bottom plate 4 both of which are provided in both ends in the axial direction of the shell portion 2, a plurality of trunnions 5 formed between the shell portion 2 and the upper lid 3 and provided for handling of the transport/storage cask 1, and a bottom support 6 arranged on an outer periphery of the bottom plate 4. Housing space 7 for the radioactive material is formed by the shell portion 2, the upper lid 3 and the bottom plate 4.

The shell portion 2 is formed by a cylindrical inner shell 8, a cylindrical outer shell 9 having a larger diameter than the above inner shell 8, and a circular gamma ray shielding layer 10 and a circular neutron shielding layer 11 both of which are placed between the inner shell 8 and the outer shell 9. The gamma ray shielding layer 10 is arranged on the inner periphery side of the neutron shielding layer 11. The upper lid 3 is detachably attached to the shell portion 2, while the bottom plate 4 is fixed to the shell portion 2 by proper fixing means such as welding.

As shown in FIG. 2, the gamma ray shielding layer 10 is formed by aligning a plurality of gamma ray shielding blocks 12 composed of lead in a block shape in the circumferential direction. The gamma ray shielding block 12 extends along an axial direction of the shell portion 2, and extending length thereof substantially corresponds to length in the axial direction of the shell portion 2. Similarly, the neutron shielding layer 11 is formed by aligning a plurality of neutron shielding blocks 13 composed of ethylene-propylene rubber serving as an organic material including hydrogen in a block shape in the circumferential direction. The neutron shielding block 13 extends along an axial direction of the shell portion 2, and extending length thereof substantially corresponds to the length in the axial direction of the shell portion 2. The inner shell 8 and the outer shell 9 are composed of carbon steel or stainless steel for example.

With the above configuration, gamma ray and neutron ray radiated from the radioactive material housed in the housing space 7 are favorably shielded by the shell portion 2, the upper lid 3 and the bottom plate 4.

Next, on the basis of FIG. 3, a detailed description will be given to a sectional structure of the shell portion 2. The "axial direction", the "radial direction" and the "circumferential direction" described in FIG. 3 correspond to the "axial direction of the shell portion 2", the "radial direction of the shell portion 2" and the "circumferential direction of the shell portion 2" respectively. For the purpose of description, although the shell portion 2 is originally curved in an arc shape, the shell portion 2 is described as fair surface in FIG. 3. Further, all the gamma ray shielding blocks 12 except two neighboring gamma ray shielding blocks 12 among a plurality of the gamma ray shielding blocks 12 aligned in the circumferential direction are not shown in the figure, and the same is applied to the neutron shielding blocks 13. From a view to easily understand the figure, hatching is omitted from a section of a thin member.

As shown in the figure, between the inner shell 8 and the outer shell 9, a plurality of heat transmission fin rows 14 for thermally connecting the inner shell 8 and the outer shell 9 and preferably transmitting decay heat of the radioactive material housed in the housing space 7 from the inner shell 8 to the outer shell 9 are placed at a predetermined interval in the circumferential direction. The heat transmission fin row 14 is formed by aligning heat transmission fins 15 serving as metal plates bent in an L shape in the axial direction without any clearance. The heat transmission fin 15 is composed of aluminum, an aluminum alloy, copper or a copper alloy: those having high thermal conductivity. A short side part 15*a* extending in the circumferential direction is abutted with the outer shell 9 or contacted therewith pressure, while a long side part 15*b* extending in the radial direction is welded to the inner shell 8.

Between the heat transmission fin rows 14 neighboring in the circumferential direction, one gamma ray shielding block 12 and one neutron shielding block 13 are housed so as to be aligned along the radial direction.

The gamma ray shielding block 12 is covered with a copper tube 16 (first metal member) having a high elasticity limit and high thermal conductivity in comparison to the gamma ray shielding block 12 composed of lead. A plurality of the gamma ray shielding blocks 12 aligned in the circumferential direction are firmly lashed towards the inner peripheral direction with using lashing belts 17 composed of stainless (SUS304). A plurality of the lashing belts 17 are provided at a predetermined interval in the axial direction, passing through the heat transmission fins 15, and inserted between the gamma ray shielding layer 10 and the neutron shielding layer 11. Into a clearance generated between the gamma ray shielding layer 10 (copper tubes 16) and the inner shell 8, a gel material composed of silicon or a silicon material is filled. In other words, over a contact surface S between the gamma ray shielding layer 10 and the inner shell 8, the gel material is coated.

The neutron shielding block 13 is different from the gamma ray shielding block 12. In the present embodiment, the neutron shielding block 13 is not covered but only sandwiched between the short side part 15*a* of the heat transmission fin 15 and the gamma ray shielding layer 10. Therefore, the lashing belt 17 slightly dents the neutron shielding block 13.

The structure of the transport/storage cask 1 is described above. Next, a description will be given to a method for manufacturing the shell portion 2 of the transport/storage cask 1 continuously with reference to FIG. 3.

Firstly, the gamma ray shielding block 12 covered with the copper tube 16 is manufactured. The gamma ray shielding block 12 covered with the above copper tube 16 can be manufactured by various methods. That is casting and press fitting. With regard to casting, firstly the copper tube 16 is made by forming a copper pipe having a circular section into a rectangular section with using a proper die, and then lead in a melted state is cast into the above copper tube 16. With regard to press fitting, lead pieces chopped along the axial direction in a block shape are press-fitted into the copper tube 16.

Almost simultaneously, the neutron shielding block 13 is formed and vulcanized with using a proper die.

Next, the gamma ray shielding blocks 12 covered with the copper tubes 16, the neutron shielding blocks 13 and the heat transmission fin rows 14 are aligned on an outer periphery of the inner shell 8 in the above order as shown in FIG. 3. In parallel with the above action, the gamma ray shielding blocks 12 covered with the copper tubes 16 are firmly lashed to the inner shell 8 in order by a plurality of the lashing belts 17.

After the heat transmission fin rows 14, the gamma ray shielding blocks 12 covered with the copper tubes 16 and the neutron shielding blocks 13 are provided on the outer periphery of the inner shell 8, the lashing belts 17 are further fastened and then the outer shell 9 is fitted to the short side parts 15*a* of the heat transmission fins 15 while slightly bending the short side parts 15*a* to the inner peripheral side.

The method for manufacturing the shell portion 2 of the transport/storage cask 1 is described above. The bottom plate 4 is fixed to the shell portion 2 manufactured as above by welding, and the bottom support 6 is attached to the outer periphery of the bottom plate 4. Then, the radioactive material is put into the housing space 7, and finally the upper lid 3 is attached to the shell portion 2 by fastening with using bolts or the like for example.

As mentioned above, the transport/storage cask 1 for the radioactive material is formed as below in the above embodiment. That is, the transport/storage cask 1 has the inner shell 8, the outer shell 9, and the circular gamma ray shielding layer 10 and the circular neutron shielding layer 11 both of which are placed between the inner shell 8 and the outer shell 9. The gamma ray shielding layer 10 is formed by aligning a plurality of the gamma ray shielding blocks 12 composed of lead in a block shape in the circumferential direction. The gamma ray shielding block 12 is covered with the copper tube 16 having a higher elasticity limit than the gamma ray shielding block 12 over the entire area in the axial direction. With the above configuration, even when external force acts on the transport/storage cask 1, the gamma ray shielding blocks 12 are not easily deformed.

In addition, with the above configuration, even when the external force acts on the transport/storage cask 1, the gamma ray shielding blocks 12 are not easily moved.

Conventionally, a rate of a manufacturing process of the transport/storage cask 1 is controlled by a casting process of the gamma ray shielding layer 10 performed on the outer periphery of the inner shell 8. Meanwhile in the above embodiment, the gamma ray shielding layer 10 is formed by a plurality of the gamma ray shielding blocks 12. Therefore, various manufacturing modes such as manufacturing the gamma ray shielding blocks 12 in a separate process prior to manufacturing the transport/storage cask 1 are available. It is possible to shorten the time required for the manufacturing process of the transport/storage cask 1.

It should be noted that the gamma ray shielding blocks 12 may be composed of a lead alloy instead of lead adopted in the above embodiment. Only a part of the gamma ray shielding block 12 in the axial direction may be covered with the copper tube 16, instead of thoroughly covering the entire area in the axial direction with the copper tube 16 as in the above embodiment.

The transport/storage cask 1 is further formed as below. That is, the metal member (copper tube 16) covering the gamma ray shielding block 12 has a higher thermal conductivity than the gamma ray shielding block 12. By adopting the metal member having the above characteristic, the above metal member contributes to the thermal conduction between the inner shell 8 and the outer shell 9. Simply stated, the design is excellent in a heat removal performance for the decay heat of the radioactive material.

The transport/storage cask 1 is further formed as below. That is, the metal member (copper tube 16) covering the gamma ray shielding block 12 is copper. By adopting the above material, the above metal member having a high elasticity limit and high thermal conductivity can be inexpensively obtained.

It should be noted that the metal member (copper tube 16) covering the gamma ray shielding block 12 may be a copper alloy, aluminum or an aluminum alloy instead of copper adopted in the above embodiment.

The transport/storage cask 1 is further formed as below. That is, the neutron shielding layer 11 is composed of an organic material including hydrogen, and the organic material is a rubber material. By adopting the above material, neutron is shielded without any problem. Since the above material includes a lot of hydrogen which is light and effective for shielding the neutron, the above material is excellent as a neutron shielding material.

It should be noted that the organic material may be other rubber materials such as silicon or a resin material such as an epoxy resin, a polyester resin and a vinylester resin instead of the ethylene-propylene rubber adopted in the above embodiment.

The transport/storage cask 1 is further formed as below. That is, the neutron shielding layer 11 is formed by aligning a plurality of the neutron shielding blocks 13 in a block shape. In such a way, by adopting a configuration in which the neutron shielding layer 11 is formed by a plurality of the neutron shielding blocks 13, various manufacturing modes such as manufacturing the neutron shielding blocks 13 in a separate process prior to manufacturing the transport/storage cask 1 are available. It is possible to shorten the time required for the manufacturing process of the transport/storage cask 1.

It should be noted that apart from the above embodiment, after a plurality of the gamma ray shielding blocks 12 are provided on the outer periphery of the inner shell 8 and the outer shell 9 is installed, the organic material may be filled between the gamma ray shielding layer 10 and the outer shell 9 so as to form the neutron shielding layer 11.

The transport/storage cask 1 is further formed as below. That is, a gel material is coated over the contact surface S where the inner shell 8 and the gamma ray shielding layer 10 are brought in contact with each other. According to the above configuration, the thermal conduction between the inner shell 8 and the outer shell 9 is improved.

The transport/storage cask 1 is further formed as below. That is, the gel material is silicon or a silicon material. According to the above configuration, the thermal conduction between the inner shell 8 and the outer shell 9 is further improved, and the gel material is also excellent in radiation resistance.

In either case of the resin material or the rubber material, the neutron shielding blocks 13 are easily deformed by the external force in comparison with the metal member. Therefore, at the time of a so-called 9 m drop test, by inertia force due to impact acceleration, the gamma ray shielding blocks 12 may be bent so as to push the neutron shielding blocks 13 to the outer peripheral side. Meanwhile, in the above embodiment, a plurality of the gamma ray shielding blocks 12 provided on the outer periphery of the inner shell 8 are firmly lashed by a plurality of the lashing belts 17 aligned at a predetermined interval in the axial direction. That is, it can be said that the above lashing belts 17 also largely contribute to uneasiness of deformation of the gamma ray shielding blocks 12.

Figure 4:
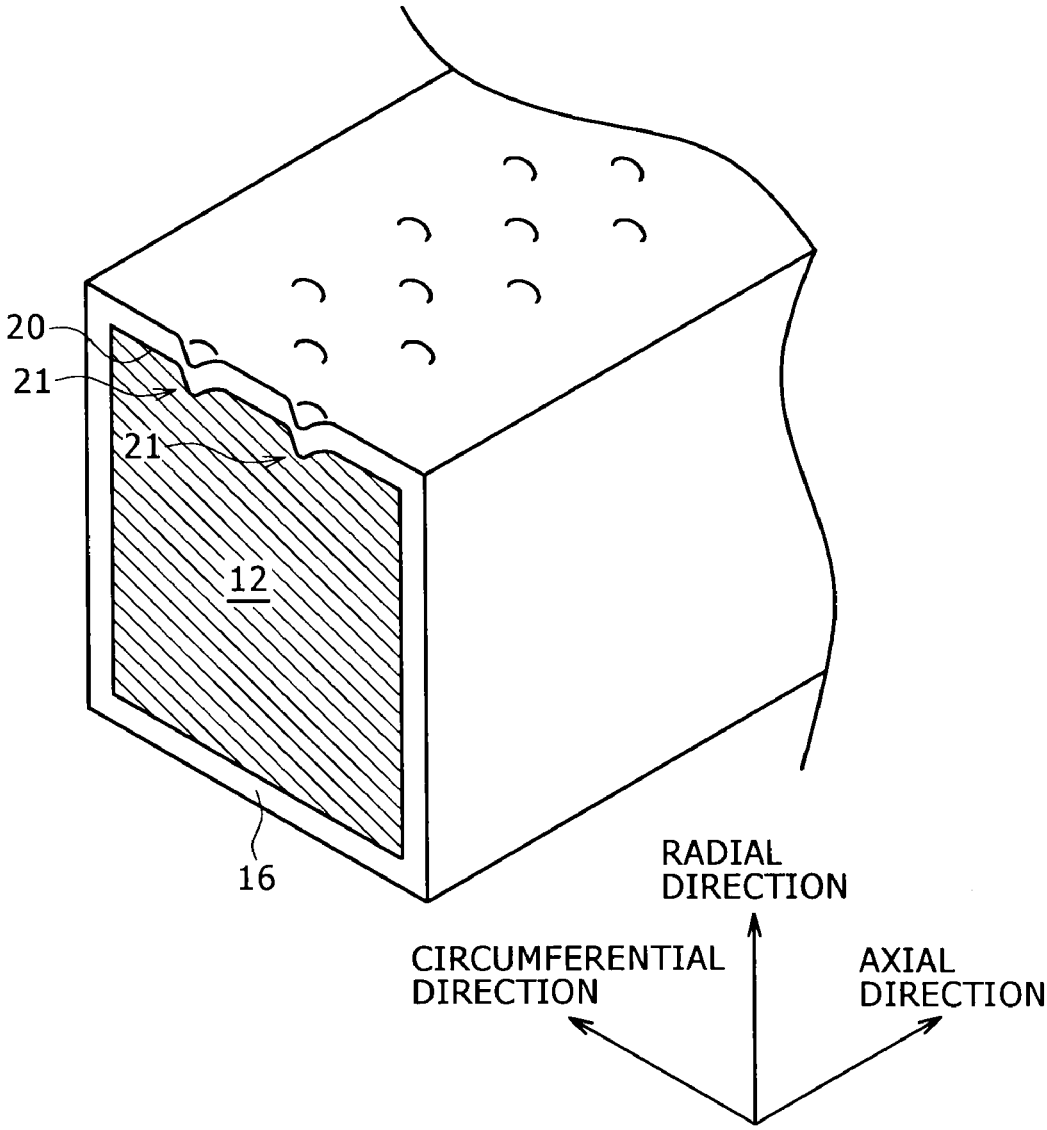
FIG. 4 is a partially perspective view showing a first modified example of the first embodiment of the present invention.

Next, with reference to FIG. 4, a description will be given to a first modified example of the first embodiment. FIG. 4 is a partially perspective view showing the first modified example of the first embodiment of the present invention. It should be noted that a description overlapping the first embodiment will be omitted.

The figure is the partially perspective view showing the gamma ray shielding block 12 covered with the copper tube 16. In the present modified example, a cover surface 20 serving as a surface of the copper tube 16 opposing to the gamma ray shielding block 12 is embossed to form a plurality of protruding portions 21 thereon at a predetermined interval. Then, the gamma ray shielding block 12 is formed by casting lead in a melted state into the copper tube 16. That is, the gamma ray shielding block 12 is formed by solidifying lead in a melted state such that the lead is in contact with the cover surface 20. By adopting the above manufacturing method, lead is solidified so as to wrap up the protruding portions 21 formed on the cover surface 20, and the gamma ray shielding block 12 and the copper tube 16 are closely engaged with each other through the above protruding portions 21. Therefore, the gamma ray shielding blocks 12 are further not easily deformed.

The protruding portions 21 may be formed after casting lead instead of before casting lead. By the above as well, the protruding portions 21 protruding into the gamma ray shielding block 12 are formed on the cover surface 20 without any problem. Further, a lead block preliminarily cast may be press-fitted into the cover surface 20.

It should be noted that in the present modified example, the protruding portions 21 are protrudingly provided only on the cover surface 20 on the outer peripheral side in the radial direction. However, instead, a number of protruding portions 21 may be protrudingly provided on all the cover surfaces 20. Although the embossment is economical for forming the protruding portions 21, the processing method is not limited to the above.

The so-called 9 m drop test is performed by three kinds of dropping: horizontal dropping; vertical dropping; and corner dropping. The vertical dropping gives the largest effect over a shape of the gamma ray shielding block 12. Therefore, by providing the protruding portions 21 so as to closely attach to the copper tube 16 as in the present modified example, it is possible to prevent the gamma ray shielding block 12 from sliding within the copper tube by the inertia force of the 9 m drop test.

Figure 5:
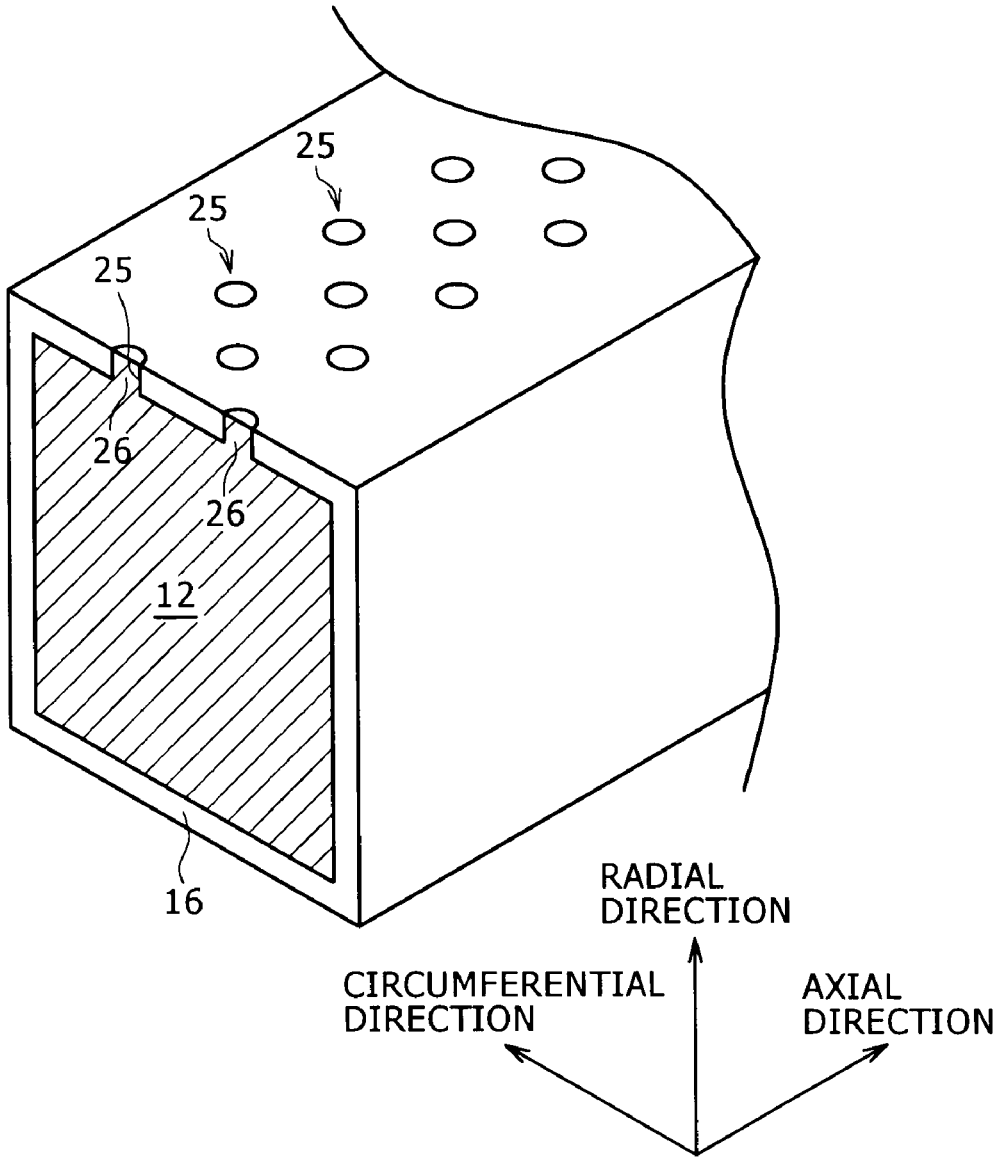
FIG. 5 is a similar view to FIG. 4, and a partially perspective view showing a second modified example of the first embodiment of the present invention.

Next, with reference to FIG. 5, a description will be given to a second modified example of the first embodiment. FIG. 5 is a similar view to FIG. 4, and a partially perspective view showing the second modified example of the first embodiment of the present invention. It should be noted that a description overlapping the first embodiment will be omitted.

The figure is the partially perspective view of the gamma ray shielding block 12 covered with the copper tube 16. In the present modified example, a plurality of circular openings 25 are formed in the copper tube 16 at a predetermined interval by punching. Then, the gamma ray shielding block 12 is formed by casting lead in a melted state into the copper tube 16. That is, the gamma ray shielding block 12 is formed by solidifying lead in a melted state so as to fill the openings 25. By adopting the above manufacturing method, cylindrical protrusions 26 integrated with the gamma ray shielding block 12 are formed in the openings 25. That is, the protrusions 26 composed of lead housed in the openings 25 are formed on a surface of the gamma ray shielding block 12, and the gamma ray shielding block 12 and the copper tube 16 are closely engaged with each other through the above protrusions 26. Therefore, the gamma ray shielding blocks 12 are further not easily deformed.

The protrusions 26 may be formed by press fitting a lead block preliminarily cast into the copper tube 16 having the openings 25 instead of forming after casting lead. By the above as well, the protrusions 26 are formed without any problem.

It should be noted that the openings 25 are formed only in the copper tube 16 on the outer peripheral side in the radial direction in the present modified example. However, instead, a number of openings 25 may be thoroughly formed over the entire copper tube 16. Although the punching is economical for forming the openings 25, instead, other processing methods such as hole drilling may be adopted. Further, the openings 25 may be not only in a circular shape but also in a rectangular shape or other polygonal shape. In addition, an aperture ratio of the openings 25 to the copper tube 16 is desirably set so that the inertia force due to the acceleration generated at the time of the so-called 9 m drop test is not more than shear force of the protrusions 26, that is, shear deformation of the protrusions 26 generated at the time of the so-called 9 m drop test is within an elastic range. This is because the aperture ratio contributes to the uneasiness of movement or the deformation of the gamma ray shielding block 12.

Figure 6:
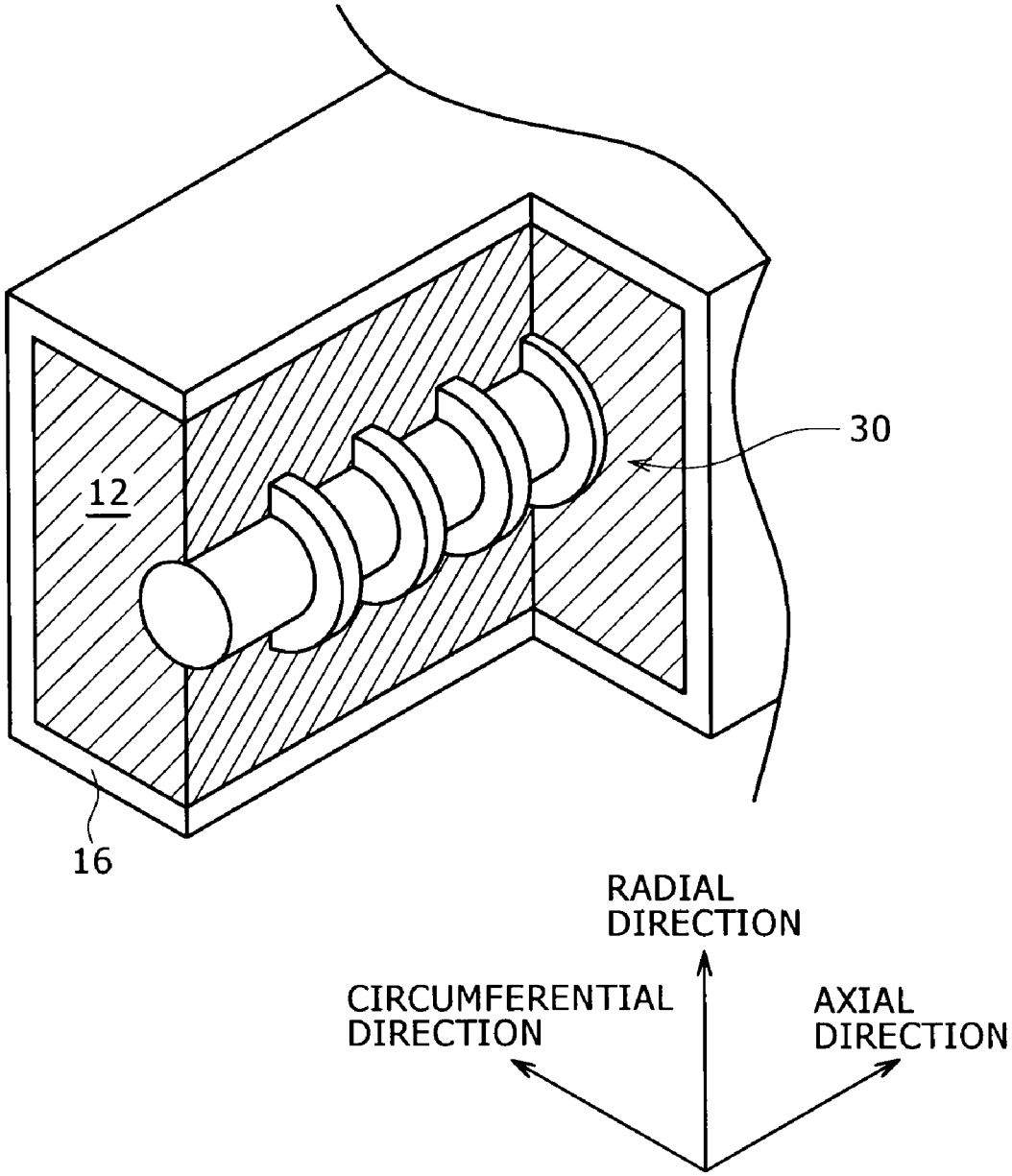
FIG. 6 is a similar view to FIG. 4, and a partially perspective view showing a third modified example of the first embodiment of the present invention.

Next, with reference to FIG. 6, a description will be given to a third modified example of the first embodiment. FIG. 6 is a similar view to FIG. 4, and a partially perspective view showing the third modified example of the first embodiment of the present invention. It should be noted that a description overlapping the first embodiment will be omitted.

The figure is the partially perspective view showing the gamma ray shielding block 12 covered with the copper tube 16. In the present modified example, a reinforcing material 30 having a higher elasticity limit than the gamma ray shielding block 12 is buried within the gamma ray shielding block 12. In the present modified example, the reinforcing material 30 is steel with different diameters and extends along an axial center of the gamma ray shielding block 12. According to the above configuration, since the reinforcing material 30 resists against the external force affecting over the transport/storage cask 1, the gamma ray shielding blocks 12 are further not easily deformed.

Figure 7:
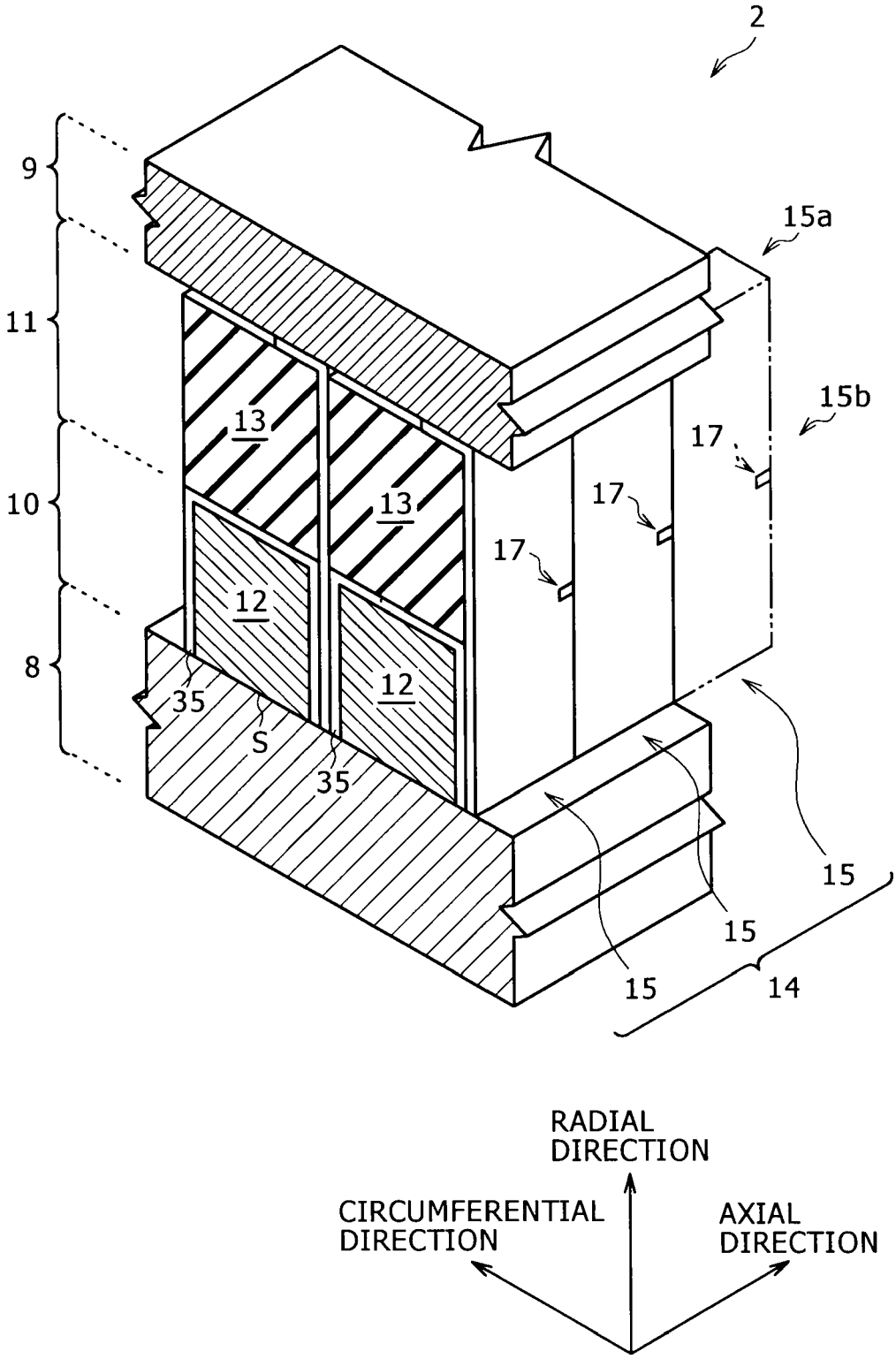
FIG. 7 is a similar view to FIG. 3 according to a second embodiment of the present invention.

Next, with reference to FIG. 7, a description will be given to a second embodiment of the present invention. FIG. 7 is a similar view to FIG. 3 according to the second embodiment of the present invention. It should be noted that a description overlapping the first embodiment will be omitted.

In the present embodiment, instead of the copper tube 16 in the first embodiment, a U shape member 35 having a U shape section is used. The above U shape member 35 is arranged so that an opening part of U shape opposes to the inner shell 8. As a result, the gamma ray shielding block 12 is surrounded by the U shape member 35 and the inner shell 8.

As mentioned above, when the metal member (U shape member 35) covering the gamma ray shielding block 12 has a section in a U shape, the following effects are obtained. That is, in comparison with the case where the metal member covering the gamma ray shielding block 12 is formed in a tubular shape, reinforcement of the gamma ray shielding block 12 by the metal member is not largely deteriorated. The metal member originally formed is flat, and with using a die having a section in a concave shape, the metal member is bent by a pressing machine and wound around the gamma ray shielding block 12. Such an economical manufacturing method can be obtained.

As a method for covering the entire periphery of side surfaces of the gamma ray shielding block 12, after winding the metal member in a U shape as mentioned above, a metal member in a plate shape is crimped with pressure so as to close the opening part of U shape.

As mentioned above, since the metal member (U shape member 35) covering the gamma ray shielding block 12 is arranged so that the opening part of U shape opposes to the inner shell 8, the following effects are obtained. That is, the metal member covering the gamma ray shielding block 12 wraps up the gamma ray shielding block 12 from the outer shell 9 side. Therefore, even with a section in a U shape, in comparison to the case where the above metal member is formed in a tubular shape, the reinforcement of the gamma ray shielding block 12 by the metal member is not inferior.

It should be noted that the "section in a U shape" representing a characteristic of shape is a generic concept including not only "section in a U shape" but also "section in a C shape", "section in a L shape" and "section in a V shape" in the present specification.

It is notable that a structure according to the present embodiment in which the economical manufacturing method is obtained can be performed by combining with configurations according to the modified examples shown in FIGS. 4, 5 and 6 without any problem. For example, with regard to the protruding portions 21 shown in FIG. 4, the above protruding portions 21 can be formed around or at the time of bending the metal member by the pressing machine. Similarly, with regard to the protrusions 26 shown in FIG. 5, the above protrusions 26 can be formed at the same time such that at the time of bending the metal member in which the openings 25 are preliminarily formed before bending by the pressing machine, by strongly pressing the metal member to the gamma ray shielding block 12, a part (lead) of the gamma ray shielding block 12 is press-fitted into the openings 25. In such a way, since a configuration shown in FIG. 7 can be easily combined with the configurations shown in FIGS. 4 to 6, the configuration should be sufficiently utilized from an economical point of view.

Figure 8:
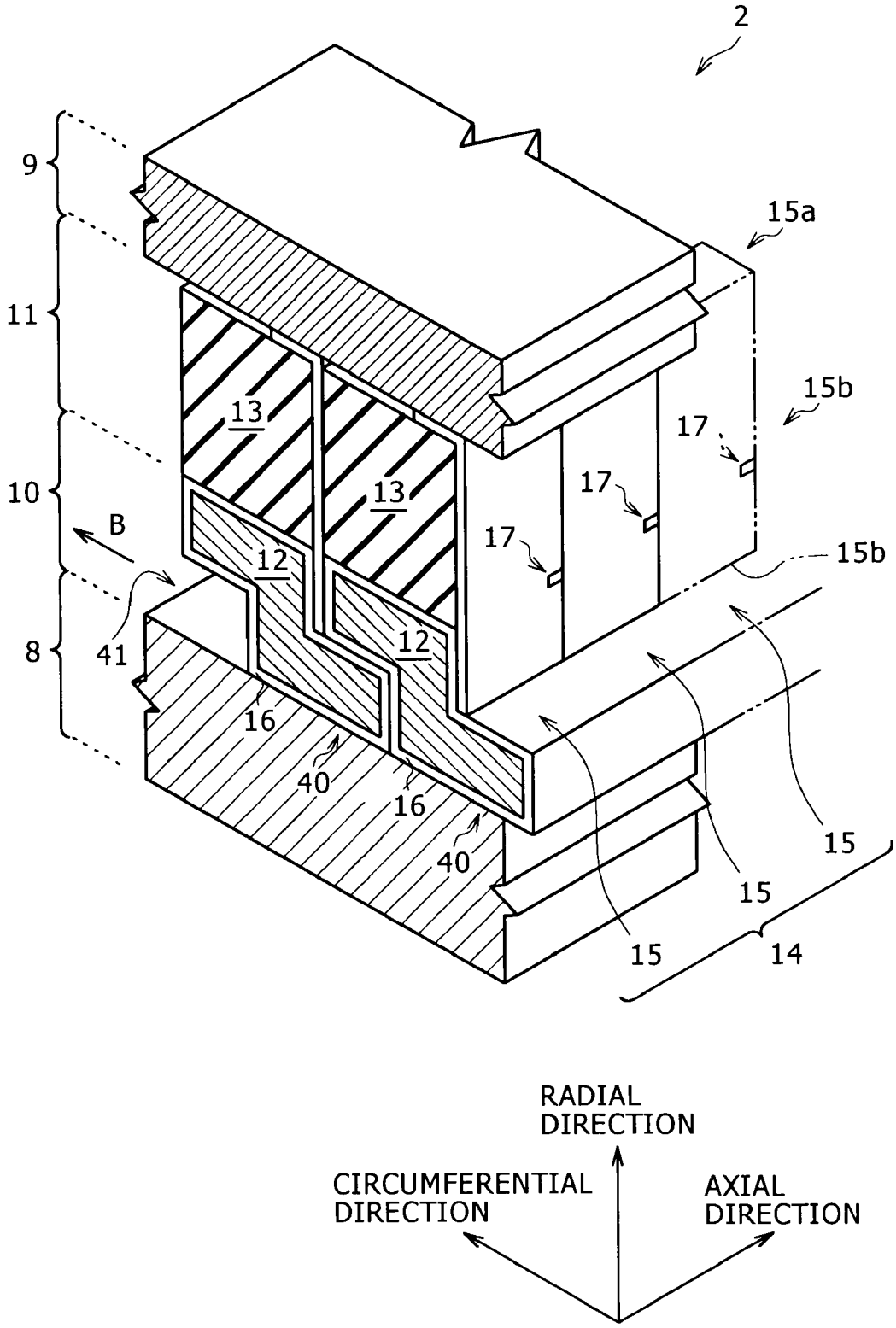
FIG. 8 is a similar view to FIG. 3 according to a third embodiment of the present invention.

Next, with reference to FIG. 8, a description will be given to a third embodiment of the present invention. FIG. 8 is a similar view to FIG. 3 according to the third embodiment of the present invention. It should be noted that a description overlapping the first embodiment will be omitted.

In the present embodiment, the gamma ray shielding block 12 has an overlapping portion 40 overlapping with other circumferentially neighboring gamma ray shielding block 12 in the radial direction. In detail, a cutout 41 opening along the circumferential direction is formed in a part on the inner peripheral side of the gamma ray shielding block 12, and the overlapping portion 40 is protrudingly provided in the opposite direction to the opening direction B of the cutout 41 from the above part on the inner peripheral side. Then, when the gamma ray shielding block 12 is aligned on the outer periphery of the inner shell 8, the overlapping portion 40 is rightly housed in the cutout 41. Apart from the first embodiment, a front end 15*c* of the long side part 15*b* of the heat transmission fin 15 is welded to the copper tube 16 covering the gamma ray shielding block 12.

In such a way, since the gamma ray shielding block 12 has the overlapping portion 40 overlapping with other circumferentially neighboring gamma ray shielding block 12 in the radial direction, radiation streaming is more surely prevented.

Figure 9:
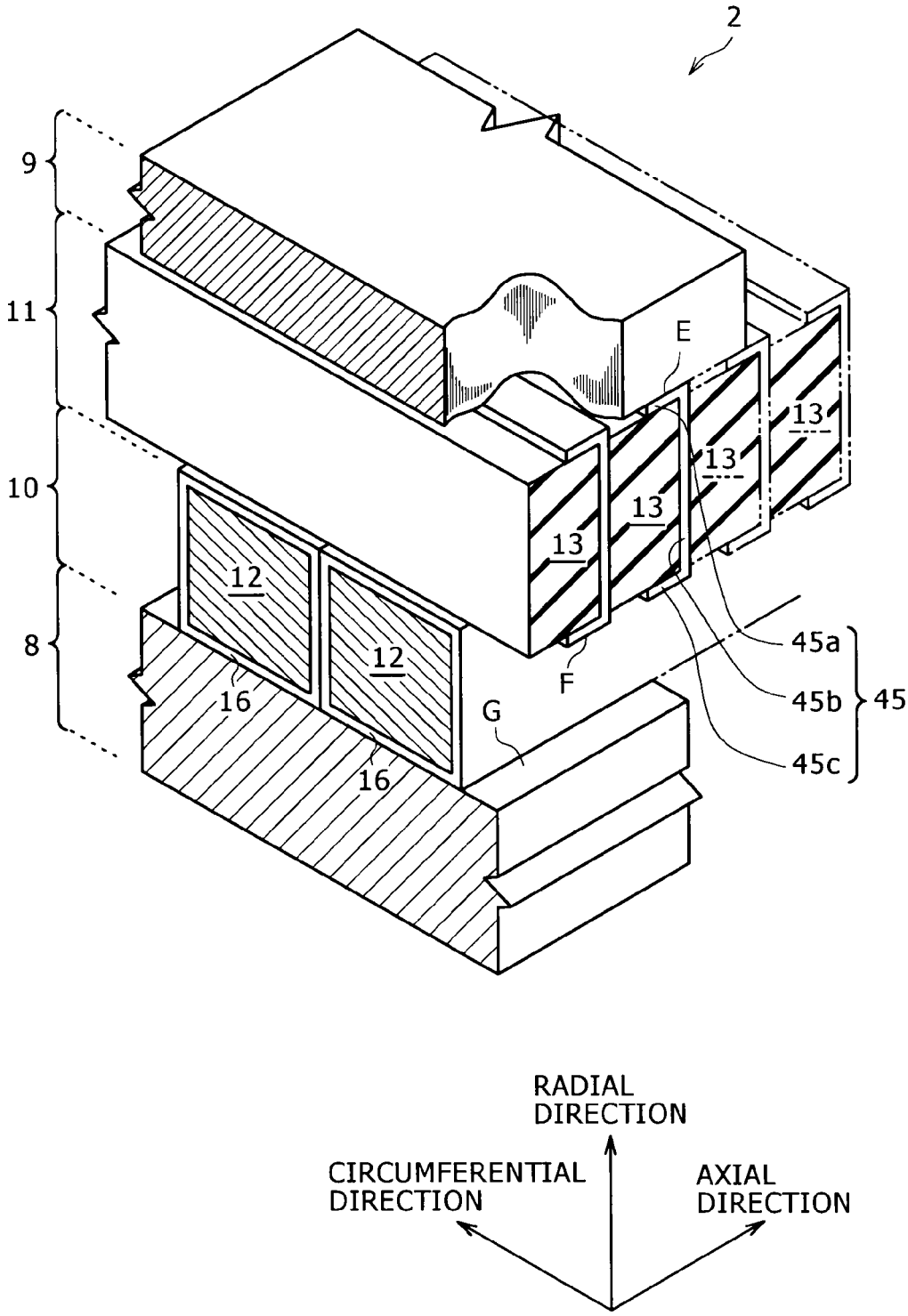
FIG. 9 is a similar view to FIG. 3 according to a fourth embodiment of the present invention.

Next, with reference to FIG. 9, a description will be given to a fourth embodiment of the present invention. FIG. 9 is a similar view to FIG. 3 according to the fourth embodiment of the present invention.

The neutron shielding layer 11 according to the present embodiment is formed by aligning a plurality of the neutron shielding blocks 13 in a block shape as well as the first embodiment. However, apart from the first embodiment, the neutron shielding blocks 13 are formed in a circular shape along the direction orthogonal to the extending direction of the gamma ray shielding blocks 12, that is, the circumferential direction. The circular neutron shielding blocks 13 are aligned at a predetermined interval in the axial direction of the transport/storage cask 1. The point that the circular neutron shielding blocks 13 are arranged on the outer periphery of a plurality of the gamma ray shielding blocks 12 is the same as the first embodiment.

The neutron shielding block 13 according to the present embodiment is partially covered by a second U shape member 45 (second metal member) composed of a copper alloy having a higher elasticity limit and higher thermal conductivity than the neutron shielding block 13, having a section in a U shape, and formed in a circular shape around an axis of the transport/storage cask 1. In detail, the above second U shape member 45 is formed by a U shape member outer periphery part 45*a* inserted between the outer shell 9 and the neutron shielding block 13, a U shape member inner periphery part 45*c* inserted between the neutron shielding block 13 and the copper tube 16 and a U shape member connecting part 45*b* for thermally connecting the U shape member outer periphery part 45*a* and the U shape member inner periphery part 45*c*.

The gel material is coated over a contact surface E between the outer shell 9 and the U shape member outer periphery part 45*a*, a contact surface F between the U shape member inner periphery part 45*c* and the copper tube 16 and a contact surface G between the copper tube 16 and the inner shell 8. The lashing belts 17 mentioned above will be omitted.

In such a way, the neutron shielding blocks 13 are formed in a circular shape and arranged on the outer periphery of a plurality of the gamma ray shielding blocks 12. Therefore, a plurality of the gamma ray shielding blocks 12 are lashed in the radial direction and hence further not easily deformed.

It should be noted that in terms of lashing the gamma ray shielding blocks 12 in the radial direction, the neutron shielding blocks 13 formed in a circular shape and the lashing belts 17 are similar to each other in functionality. Therefore, the configuration in which the lashing belts 17 are omitted in the present embodiment is worthwhile to be adopted in terms of simplifying the structure.

Since the neutron shielding block 13 is partially covered with the second U shape member 45 having a higher elasticity limit than the neutron shielding block 13, the neutron shielding blocks 13 are not easily deformed. Further, since the neutron shielding blocks 13 are not easily deformed, the gamma ray shielding blocks 12 lashed on the inner peripheral side thereof are further not easily deformed.

Of course, instead of the configuration in which the neutron shielding block 13 is partially covered with the second U shape member 45, the configuration in which the entire neutron shielding block 13 is covered with a tubular metal member may be adopted.

Since the metal member (second U shape member 45) covering the neutron shielding block 13 has a higher thermal conductivity than the neutron shielding block 13, the metal member (second U shape member 45) contributes to the thermal conduction between the inner shell and the outer shell.

In the present embodiment, the inner shell 8 and the outer shell 9 are thermally connected to each other by the copper tube 16 and the second U shape member 45. Therefore, even when the heat transmission fin row 14 or the heat transmission fin 15 shown in FIG. 3 is omitted, the thermal conduction between the inner shell 8 and the outer shell 9 is preferable.

Since the metal member (second U shape member 45) covering the neutron shielding block 13 is a copper alloy, the metal member having a high elasticity limit and high thermal conductivity can be inexpensively obtained.

It should be noted that the second U shape member 45 may be aluminum, an aluminum alloy or copper instead of a copper alloy.

When the metal member (second U shape member 45) covering the neutron shielding block 13 has a section in a U shape, the following effects are obtained. That is, in comparison with the case where the metal member is formed in a tubular shape, reinforcement of the neutron shielding block 13 by the metal member is not largely deteriorated. The metal member originally formed is flat, and with using a die having a section in a concave shape, the metal member is bent by a pressing machine and wound around the neutron shielding block 13. Such an economical manufacturing method can be obtained.

It should be noted that length in the axial direction of the U shape member outer periphery part 45*a* and the U shape member inner periphery part 45*c*, that is, area of the contact surface between the U shape member outer periphery part 45*a* and the outer shell 9, and area of the contact surface between the U shape member inner periphery part 45*c* and the copper tube 16 are preferably set in sufficient consideration to for example a heat transmission performance between the inner shell 8 and the outer shell 9 and structure strength and the like. As shown in the figure, a clearance between the neutron shielding block 13 and the outer shell 9 or between the neutron shielding block 13 and the copper tube 16 is desirable on a point that thermal expansion in the radial direction of the neutron shielding block 13 is permitted to some extent.

Since the gel material is coated over the contact surfaces E, F and G where the inner shell 8, the outer shell 9, the gamma ray shielding layer 10 and the neutron shielding layer 11 are brought in contact with each other, the thermal conduction between the inner shell 8 and the outer shell 9 is improved.

Of course, instead of coating the gel material over all the contact surfaces E, F and G, the gel material may be coated over at least one of the contact surfaces E, F and G. In such a case as well, in comparison to the case where the gel material is not at all coated, the thermal conduction between the inner shell 8 and the outer shell 9 is improved.

We claim:

1. A transport/storage cask for a radioactive material, comprising:

an inner shell;

an outer shell;

a circular gamma ray shielding layer placed between said inner shell and said outer shell, said gamma ray shielding layer being formed by aligning a plurality of gamma ray shielding blocks composed of lead or a lead alloy in a block shape in the circumferential direction;

a circular neutron shielding layer placed between said inner shell and said outer shell;

a first metal member having a higher elasticity limit than the gamma ray shielding blocks and covering at least a part of each of the gamma ray shielding blocks; and a heat transmission fin formed of a thermally conductive material and extending to said outer shell, wherein said heat transmission fin does not contact said plurality of gamma ray shielding blocks.

2. The transport/storage cask for the radioactive material according to claim 1, wherein the first metal member has a higher thermal conductivity than the gamma ray shielding blocks.

3. The transport/storage cask for the radioactive material according to claim 2, wherein the first metal member is aluminum, an aluminum alloy, copper or a copper alloy.

4. The transport/storage cask for the radioactive material according to claim 1, wherein a plurality of protruding portions for protruding into each of the gamma ray shielding blocks are formed on a cover surface serving as a surface of the first metal member opposing to each of the gamma ray shielding blocks.

5. The transport/storage cask for the radioactive material according to claim 1, wherein a plurality of openings are formed in the first metal member, and a plurality of protrusions are formed in each of the gamma ray shielding blocks, at least a part of the protrusions being placed within the openings.

6. The transport/storage cask for the radioactive material according to claim 1, wherein the first metal member has a section in a U shape.

7. The transport/storage cask for the radioactive material according to claim 6, wherein the first metal member is arranged so that an opening part of the U shape is adjacent said inner shell.

8. The transport/storage cask for the radioactive material according to claim 1, wherein each of the gamma ray shielding blocks has an overlapping portion overlapping with other circumferentially neighboring gamma ray shielding block in the radial direction.

9. The transport/storage cask for the radioactive material according to claim 1, wherein said neutron shielding layer is composed of an organic material including hydrogen, and the organic material is a resin material or a rubber material.

10. The transport/storage cask for the radioactive material according to claim 1, wherein said neutron shielding layer is formed by aligning a plurality of neutron shielding blocks in a block shape.

11. The transport/storage cask for the radioactive material according to claim 10, wherein the neutron shielding blocks are formed in a circular shape and arranged on an outer periphery of a plurality of the gamma ray shielding blocks.

12. The transport/storage cask for the radioactive material according to claim 10, wherein at least a part of each of the neutron shielding blocks is covered with a second metal member having a higher elasticity limit than the neutron shielding blocks.

13. The transport/storage cask for the radioactive material according to claim 12, wherein the second metal member has a higher thermal conductivity than the neutron shielding blocks.

14. The transport/storage cask for the radioactive material according to claim 13, wherein the second metal member is aluminum, an aluminum alloy, copper or a copper alloy.

15. The transport/storage cask for the radioactive material according to claim 12, wherein the second metal member has a section in a U shape.

16. The transport/storage cask for the radioactive material according to claim 1, wherein a gel material is coated over at least one of among a contact surface between said inner shell and said gamma ray shielding layer or the neutron shielding layer, a contact surface between said gamma ray shielding layer and said neutron shielding layer, and a contact surface between said outer shell and said gamma ray shielding layer or said neutron shielding layer.

17. The transport/storage cask for the radioactive material according to claim 16, wherein the gel material is silicon or a silicon material.

18. The transport/storage cask for the radioactive material according to claim 1, wherein a reinforcing material having a higher elasticity limit than the gamma ray shielding blocks is buried within each of the gamma ray shielding blocks.

19. The transport/storage cask for the radioactive material according to claim 1, wherein the heat transmission fin is L-shaped and includes a part extending from the inner shell to the outer shell; and a circumferentially extending part abutting the outer shell.

20. The transport/storage cask for the radioactive material according to claim 1, wherein the heat transmission fin contacts the first metal member.

* * * * *